United States Patent [19]

Besic

[11] Patent Number: 4,808,093

[45] Date of Patent: Feb. 28, 1989

[54] VERTICAL PLUNGER PUMP WITH ACTIVE PLUNGER HEAT EXCHANGE

[75] Inventor: Dragan Besic, West Caldwell, N.J.

[73] Assignee: Dresser Industries, Inc., Dallas, Tex.

[21] Appl. No.: 28,369

[22] Filed: Mar. 20, 1987

[51] Int. Cl.[4] ..... F04B 21/00

[52] U.S. Cl. ..... 417/539; 92/111; 92/186; 417/568

[58] Field of Search ..... 417/539, 568; 92/110, 92/111, 109, 186; 123/41.35, 41.37; 184/24

[56] References Cited

U.S. PATENT DOCUMENTS

| | | | |
|---|---|---|---|
| 129,631 | 7/1872 | Waring | 92/111 |
| 1,111,840 | 9/1914 | Koenig | 123/41.37 |
| 1,121,202 | 12/1914 | Rembold | 123/41.37 |
| 1,315,253 | 9/1919 | Stevens | 92/111 X |
| 1,689,049 | 10/1928 | Prosser | 92/111 X |
| 1,747,948 | 2/1930 | Pescara . | |
| 1,915,284 | 6/1933 | Becker | 123/41.37 X |
| 2,361,316 | 10/1944 | Newton . | |
| 2,734,494 | 2/1956 | Waterval | 92/186 X |
| 2,865,349 | 12/1958 | MacDonald | 123/41.37 |
| 3,314,402 | 4/1967 | Tillack . | |
| 3,604,056 | 9/1971 | Larsen | 92/186 X |

FOREIGN PATENT DOCUMENTS

| | | | |
|---|---|---|---|
| 18154 | of 0000 | Fed. Rep. of Germany | 417/539 |
| 1177064 | 4/1959 | France | 417/539 |
| 19964 | 2/1980 | Japan | 92/110 |

*Primary Examiner*—Leonard E. Smith

[57] ABSTRACT

A method and apparatus are disclosed for heat exchange between the plunger in a plunger pump and a supply of lubricant within the plunger pump. The plunger may be heated or cooled by circulating a lubricant through a reservoir formed in the plunger and back into the sump of the plunger pump.

9 Claims, 2 Drawing Sheets

VERTICAL PLUNGER PUMP WITH ACTIVE PLUNGER HEAT EXCHANGE

TECHNICAL FIELD

This invention relates to reciprocating plunger pumps, and more particularly to providing heat exchange between the vertical plunger and the oil lubricating system of the pump. The invention is well suited to high temperature pumping operations.

BACKGROUND ART

Plunger pumps are adapted to rugged, continuous duty pumping of liquids and slurries over a wide range of temperatures. Vertical plunger type pumps provide heavy duty, high pressure service, improved reliability, and less costly maintenance. The vertical design also occupies less floor space and therefore requires less costly foundations than other pump types. These attributes make this pump design ideal for energy related technologies such as coal liquification and gasification, mineral and coal pipelines.

Packing material is provided in plunger pumps to act as a seal between the plunger and the cylinder in which it reciprocates. No packing material or style is fully satisfactory in a high temperature, continuous duty application. To improve the packing material service life, the temperature of the packing environment must be lowered.

Conversely, there are service conditions which require that the temperature of the packing environment be raised. Raising the packing environment temperature is desirable where the viscosity of the fluid being pumped is too high at ambient temperatures.

One way of lowering or raising the packing environment temperature is to cool or heat the plunger or piston which is in proximity to the packing. Methods of plunger cooling are known, but they rely on external or auxiliary coolant supply or flexible hoses, and require frequent maintenance.

SUMMARY OF THE INVENTION

Thus it is an object of the present invention to provide a plunger or other pump with a reciprocating plunger which may be cooled or heated.

It is another object of the present invention to provide an apparatus for plunger heat exchange which is readily adapted to existing pump designs.

It is yet another object of the present invention to provide a heat exchange system which requires no additional moving parts to the plunger pump apparatus.

It is a further object of the present invention to provide a heat exchange system that incorporates the oil circulating system of the pump into which it is incorporated.

It is still a further object of the present invention to provide a heat exchange system for the plunger of a plunger type pump which requires little or no additional maintenance.

Accordingly, an active heat exchange system is provided which includes a plunger having an internal intake, reservoir and return line. The internal intake connects to a first transverse passageway within the upper crosshead. The internal return line connects to a second transverse passageway in the upper crosshead. The passageways in the crosshead are connected to conduits which carry lubricant to and from the lubricant supply of the pump. The lubricant is normally cooled via an external heat exchanger which is the ultimate heat sink for the plunger heat under these schemes.

DESCRIPTION OF THE PREFERRED EMBODIMENT

Figure 1:
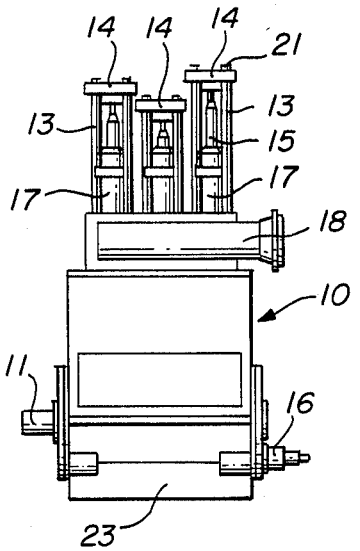
FIG. 1 shows a side elevation of a vertical plunger pump of the prior art. One of the connecting rods on the right has been broken away for clarity.

FIG. 1 shows the some of the components of a vertical plunger pump 10 of the prior art, to which the improvements of the present invention are adaptable. An input shaft 11 delivers rotary power to crankshaft 12 (shown more clearly in FIG. 2). Rotation of the crankshaft is converted into linear motion of side rods 13. The side rods are in turn fastened to crossheads 14 to which the plunger 15 are attached. An oil pump 16, driven by the crankshaft, delivers lubricating oil through internal passages to points throughout the pump. The reciprocating action of the plunger within the cylindrical stuffing boxes 17 causes a fluid or slurry to be drawn through an intake 18 and delivered as an output from the pump.

Figure 2:
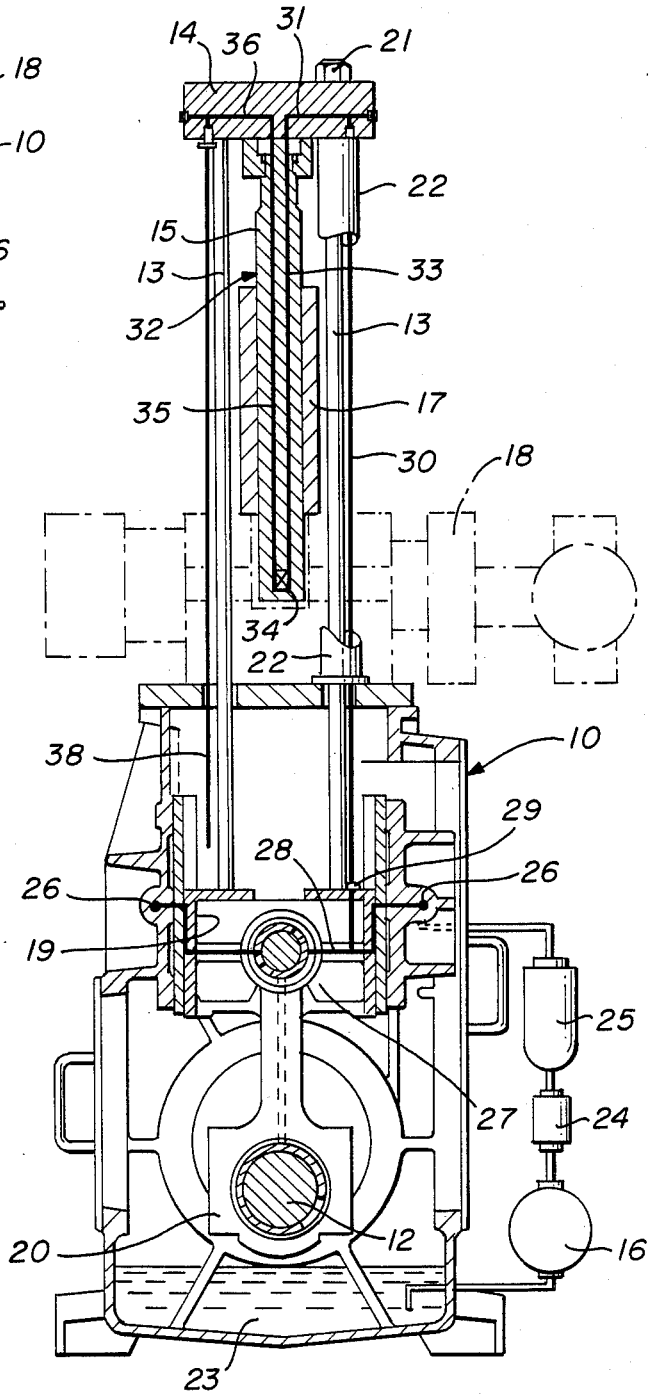
FIG. 2 shows a front elevation of a vertical plunger pump in partial cross section.

As seen in FIG. 2, motion of the crankshaft 12 is delivered to a lower crosshead 19, by a connecting rod 20. The side rods 13 are attached to the reciprocating lower crosshead. The top of the side rods are affixed to the upper crosshead 14 by bolts 21. A telescopic outer cover 22 encloses the individual side rods.

Figure 3:
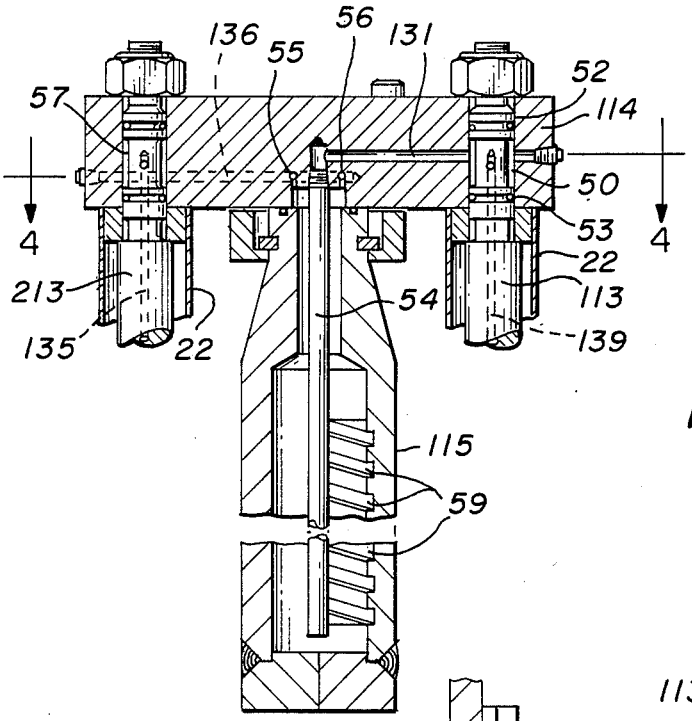
FIG. 3 shows an alternate arrangement of side rods, upper crosshead, hollow plunger and transverse passageways in partial cross section.

Lubricant in the sump 23 is delivered under pressure by an oil pump 16 through an oil filter 24 and an oil cooler 25 to key locations within the pump. As shown in FIG. 2, oil is introduced into a header 26. From the header it is distributed to the wrist pin bearing surfaces 27 by a supply line 28. The supply line is branched to a fitting 29 on the lower crosshead. From the fitting, oil is delivered by an external conduit 30 to the upper crosshead. As will be explained, the conduit may pass within the side rods 13 (as shown in FIG. 3) or externally to the telescopic covers 22. In FIG. 2, the conduit passes to the crossheads externally of the side rods and internally of the telescopic covers. The upper end of the conduit 30 enters the upper crosshead 14. A short transverse passage 31 connects the supply of lubricant from the conduit to an internal passageway 32 in the plunger 15. The internal passageway 32 consists of a descending intake 33, a reservoir 34 and an ascending return line 35. The reservoir is provided to obtain sufficient surface area, within the plunger, for obtaining satisfactory heat exchange. From the ascending return line 35, heat exchange medium travels through a second short transverse passage 36 in the upper crosshead and into a second conduit 37. The second conduit passes through the pump case and discharges 38 within the sump. Thus lubricant from the plunger pump system is diverted and acts as a coolant or heat exchange means to the plunger, and in turn to the packing environment.

Figure 4:
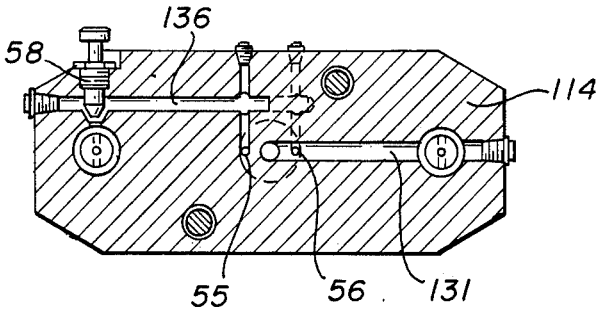
FIG. 4 is a cross section through lines 4—4 of FIG. 3, showing the upper crosshead and flow regulator.
Figure 5:
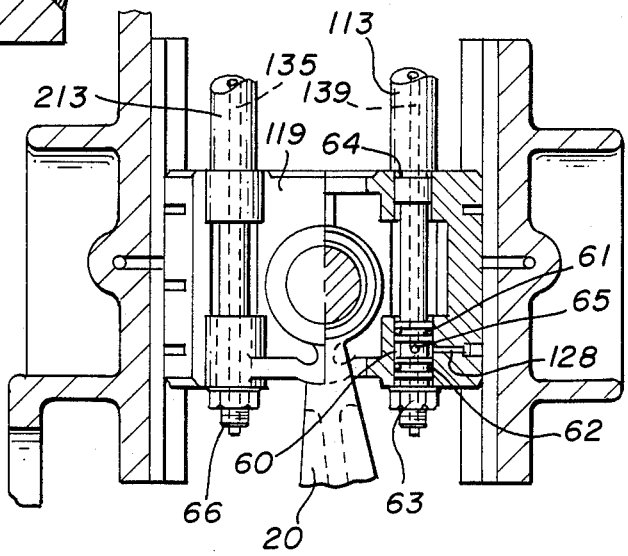
FIG. 5 is a partial cross section showing a lower crosshead adapted to carry side rods having internal conduits.

FIGS. 3–5 demonstrate an alternate method for introducing a heat exchanging lubricant into the transverse passageways 131 in an upper crosshead 114. FIG. 3 shows that fluid may be introduced from a first conduit 139 which is internal to the side rods. Once inside the crosshead the fluid passes through an opening in the side rod and into a first pocket 50. The pocket has seals 52, 53 at either end. From the pocket 50, fluid enters a transverse passageway 131, from where it enters a tube 54 internal to the plunger 115. The plunger may be provided with internal fins 59, in the form of threads or fins in order to promote optimum heat exchange. The fluid rises in the plunger and enters a second transverse passageway 136 via two openings 55, 56. From the second transverse passageway 136, fluid enters a second pocket 57 similar to the first pocket. The fluid then enters a second conduit 135 in the side rod 213 and returns to the sump. In FIG. 4 it can be seen that a flow regulator 58 may be employed to regulate the flow of fluid into the second conduit.

FIG. 5 demonstrates a lower crosshead 119 which is adapted to supply fluid to the conduit formed within the side rods as shown in FIGS. 3 and 4. Heat exchanging lubricant is introduced into the lower crosshead from a header into a supply line 128. From a supply line 128, fluid enters a pocket 60, similar to the first pocket 50, having seals 61, 62 adapted to seal the pocket 60. The side rod 113 is retained by a threaded fastener 63 at one end and by a shoulder 64 at the other. From the pocket 60, fluid enters the internal conduit 139 through an opening 65. FIG. 5 also shows how fluid returning from the upper crosshead 114 passes through a conduit 135 in the side rod 213 and then through an aperture 66 in the side rod 213.

It will be appreciated that the principles of the active plunger heat exchanger for use in vertical plunger pumps is disclosed by way of example and that the invention may be practiced in ways other than that specifically disclosed herein. The description provided should not be considered a limitation to the scope of the invention as set forth in the objects thereof and in the accompanying claims.

What is claimed is:

1. In a plunger pump having an internal lubricant distribution system, a plunger, first and second side rods, and upper and lower crossheads, the improvement comprising:

a plunger having an internal reservoir, the reservoir further comprising intake and return means;

a first transverse passageway located within the upper crosshead, which cooperates with the reservoir intake means;

a second transverse passageway in the upper crosshead, which cooperates with the reservoir return means;

the first transverse passageway cooperating with a conduit internal to the first side rod;

the second transverse passageway cooperating with a conduit internal to the second side rods;

the reservoir comprising an enlarged void which cooperates with the first and second transverse passageways; and the conduit internal to the first side rod supplied by and cooperating with a portion of the internal lubricant distribution system internal to the lower crosshead.

2. In a plunger pump having an internal lubricant distribution system, a plunger, first and second side rods, and upper and lower crossheads, the improvement comprising:

a plunger having an internal reservoir, the reservoir further comprising intake and return means;

a first transverse passageway located within the upper crosshead, which cooperates with the reservoir intake means;

a second transverse passageway in the upper crosshead, which cooperates with the reservoir return means;

the first transverse passageway cooperating with a conduit external to the first side rod;

the second transverse passageway cooperating with a conduit external to the second side rod;

the reservoir comprising an enlarged void which cooperates with the first and second transverse passageways; and the conduit external to the first side rod terminating at and cooperating with a portion of the internal lubricant distribution system located within the lower crosshead.

3. The improvement of claim 2, wherein:

the conduit external to the second side rod terminates within the vertical plunger pump.

4. In a plunger pump having an internal lubricant distribution system, a plunger, first and second side rods, and upper and lower crossheads, the improvement comprising:

a plunger having an internal reservoir, the reservoir further comprising intake and return means;

a first transverse passageway located within the upper crosshead, which cooperates with the reservoir intake means;

a second transverse passageway in the upper crosshead, which cooperates with the reservoir return means;

the first transverse passageway cooperating with a conduit external to the first side rod;

the second transverse passageway cooperating with a conduit external to the second side rod; wherein the conduits external to the first and second side rods are also internal to a telescopic cover surrounding the individual side rods.

5. A method of heat exchange in a vertical plunger pump, comprising the steps of:

collecting lubricant from a sump internal to the plunger pump;

distributing the lubricant to a header;

discharging said lubricant into portions of a lubricant distribution system internal to a lower crosshead;

further discharging lubricant from those portions of the lubricant distribution system internal to the lower cross head to a first conduit;

directing the flow of lubricant in the first conduit to a first transverse passageway in an upper crosshead;

introducing the flow from the first transverse passageway into a reservoir internal to the plunger;

discharging the flow of lubricant from the reservoir into a second transverse passageway in the upper crosshead; and further discharging the lubricant from the second transverse passageway in the upper crosshead to a second conduit.

6. The method of claim 5, wherein:

the first conduit is located within a first side rod.

7. The method of claim 6, wherein:

the second conduit is located within a second side rod.

8. The method of claim 7, wherein:

collecting lubricant from the sump is accomplished by an oil pump driven by a crankshaft within the pump.

9. In a vertical plunger pump, the improvement comprising:

a conduit adapted to carry fluid from a port located on a lower crosshead, to an upper crosshead;

the upper crosshead having a plunger attached to it, the plunger having formed therein a reservoir, the upper crosshead further comprising a supply line affixed thereto and extending into the reservoir.

* * * * *